US008391740B2

(12) United States Patent
Ogasawara

(10) Patent No.: US 8,391,740 B2
(45) Date of Patent: Mar. 5, 2013

(54) IMAGE FORMING APPARATUS HAVING DISPLAY DEVICE

(75) Inventor: Kenji Ogasawara, Tondabayashi (JP)

(73) Assignee: Sharp Kabushiki Kaisha, Osaka (JP)

( * ) Notice: Subject to any disclaimer, the term of this patent is extended or adjusted under 35 U.S.C. 154(b) by 503 days.

(21) Appl. No.: 12/402,530

(22) Filed: Mar. 12, 2009

(65) Prior Publication Data

US 2009/0232537 A1 Sep. 17, 2009

(30) Foreign Application Priority Data

Mar. 14, 2008 (JP) ..... 2008-066792

(51) Int. Cl.
*G03G 15/00* (2006.01)

(52) U.S. Cl. ..... 399/81; 361/679.07

(58) Field of Classification Search ..... 399/11, 399/18, 21, 81, 107; 361/679.01, 679.05, 361/679.06, 679.07, 679.21, 679.4
See application file for complete search history.

(56) References Cited

U.S. PATENT DOCUMENTS 5,602,625 A 2/1997 Okamoto et al.
6,314,254 B1 * 11/2001 Wakahara ..... 399/81
6,750,878 B1 * 6/2004 Tatsuo et al. ..... 715/705
2003/0218785 A1 * 11/2003 Sato ..... 358/501
2006/0171734 A1 * 8/2006 Maeda ..... 399/81
2007/0030223 A1 * 2/2007 Moon ..... 345/87

FOREIGN PATENT DOCUMENTS

| | | | |
|---|---|---|---|
| JP | 02-244220 | * | 9/1990 |
| JP | 9-6185 | | 1/1997 |
| JP | 2000-155450 | | 6/2000 |
| JP | 2000-155508 | | 6/2000 |
| JP | 2000-330429 | | 11/2000 |
| JP | 2003-323084 | | 11/2003 |
| JP | 2006-023519 | | 1/2006 |
| JP | 2006-231675 | | 9/2006 |
| JP | 2007-122073 | | 5/2007 |

* cited by examiner

*Primary Examiner* — Walter L Lindsay, Jr.
*Assistant Examiner* — Benjamin Schmitt
(74) *Attorney, Agent, or Firm* — Renner, Otto, Boisselle & Sklar, LLP

(57) ABSTRACT

A display device and an image forming apparatus capable of reducing discomfort of a worker during maintenance work and improving the work efficiency, are provided. In a copier, an orientation of a display screen of a display device is detected and when the display screen changes its orientation, an image appearing on the display screen changes accordingly. It is determined how the copier is viewed from a worker, and then screen display is performed so that an image appearing on the display device looks the same as the copier which the worker directly sees.

4 Claims, 23 Drawing Sheets

IMAGE FORMING APPARATUS HAVING DISPLAY DEVICE

CROSS-REFERENCE TO RELATED APPLICATION

This application claims priority to Japanese Patent Application No. 2008-066792, which was filed on Mar. 14, 2008, the contents of which are incorporated herein by reference in its entirety.

BACKGROUND OF THE INVENTION

1. Field of the Invention

The present invention relates to a display device and an image forming apparatus having the display device.

2. Description of the Related Art

A printing processing apparatus disclosed in Japanese Unexamined Patent Publication JP-A 2006-231675 has a removable operating part and a section for locating the position of the operating part, and is configured with a display unit which shows information in accordance with the position of the operating part. To clear a jam occurring at a very end of a long copying/printing machine, the distance from a display to a handling area will make it hard for a user to carry out a task for releasing the jam with his/her eyes laid on the display. The above apparatus therefore changes the display depending on a position to which the operating part has moved, thereby improving operability.

An image forming apparatus disclosed in Japanese Unexamined Patent Publication JP-A 2000-330429 is a copier or the like image forming apparatus, having on its top an elevation liquid crystal display 1 for graphically explaining how to handle a recording paper jam. In the apparatus, user's removal of an access door to deal with a jam will be followed by detection of which door has been removed, and the contrast around the door detected is set to be the highest in a liquid crystal display section on the elevation liquid crystal display 1. The jam clearing operability is thus improved from the vicinity of each access door removed by a user who has moved from the normal position for the purpose of clearing recording paper jam.

An image forming apparatus disclosed by Japanese Unexamined Patent Publication JP-A 2000-155508 has a display section which shows, when a jam occurs, such an image in silhouette that a user can locate a position where the jam occurs, as well as moving image data to explain how to clear the jam.

In the printing processing apparatus disclosed in JP-A 2006-231675, a main body communicates with the operating part by radio to locate the position of the operating part and shows on the display unit the situation of the apparatus around the operating part. The display unit mounted in the operating part has to be therefore reduced in size and weight, resulting in lower visibility. In addition, a worker needs to hold the operating section with his/her hand while working to clear jams, which poses a problem for workability.

The image forming apparatus disclosed in JP-A 2000-330429 merely improves visibility of the liquid crystal display section by changing its contrast with drive voltage under control and does not include any device which refers to a positional relation between a worker and the display device to display information at the angle at which the worker inspects the apparatus, with the result that visibility and workability for workers will not fully improve.

SUMMARY OF THE INVENTION

An object of the invention is to provide a display device and an image forming apparatus capable of reducing discomfort of a worker during maintenance work and improving the work efficiency.

The invention provides a display device comprising:

a display portion for displaying apparatus status and setting;

a support portion for supporting the display portion in a manner that an orientation of a display screen of the display portion is displaceable;

a detecting portion for detecting displacement of the display portion; and a control unit for changing display content appearing on the display portion according to a detection result of the detecting unit.

According to the invention, the display content appearing on the display portion changes in accordance with the displacement of the display portion, with the result that, when, for example, a worker moves the display portion during maintenance work, then an image appearing on the display screen of the display portion looks the same as the apparatus which the worker directly sees. Accordingly, even when the worker performs the maintenance work while looking at the display screen of the display portion, it is possible to reduce discomfort of the worker and improve the work efficiency, because the image being displayed is correlated with the apparatus being seen directly.

Further, in the invention, it is preferable that the support portion supports the display portion so as to be displaceable at least in a vertical or horizontal direction thereof.

According to the invention, the display portion can be displaced by the support portion at least in the vertical or horizontal direction, with the result that a worker can turn the display screen in his/her desired direction during work.

Further, in the invention, it is preferable that the support portion has one or more arms angularly displaceable.

According to the invention, the support portion has one or a plurality of arms, and the arm or arms can be angularly displaced.

This allows a worker to turn the display screen in his/her desired direction during work.

Further, in the invention, it is preferable that the support portion has one or more arms which expand and contract.

According to the invention, the support portion has one or a plurality of arms, and the arm or arms can expand and contract.

This allows a worker to turn the display screen in his/her desired direction during work.

The invention provides an image forming apparatus having the above-mentioned display device.

According to the invention, the image forming apparatus having the above-mentioned display device can enhance work efficiency of its maintenance work, etc.

Further, in the invention, it is preferable that the support portion is configured so as to enable the display device to move longitudinally of the image forming apparatus.

According to the invention, the support portion is configured so as to enable the display device to move longitudinally of the image forming apparatus.

This allows the display device to move to a position at which a worker can work more comfortably with the display device, even with optional devices connected to the image forming apparatus.

Further, in the invention, it is preferable that the display portion can display an external view of the image forming apparatus, and the control unit changes the external view being displayed on the display portion according to a detection result of the detecting portion.

According to the invention, the external view being displayed changes depending on a position of the display portion, so that it is possible to reduce discomfort of a worker during maintenance work, etc. and to improve the work efficiency.

Further, in the invention, it is preferable that the display portion displays a procedure of maintenance work.

According to the invention, the display portion displays a procedure of maintenance work, allowing a worker to perform maintenance work easily by looking at the display screen of the display portion.

Further, in the invention, it is preferable that the maintenance work relates to clearing a jam.

According to the invention, it is possible to show a work procedure for clearing a jam as the procedure of maintenance work.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
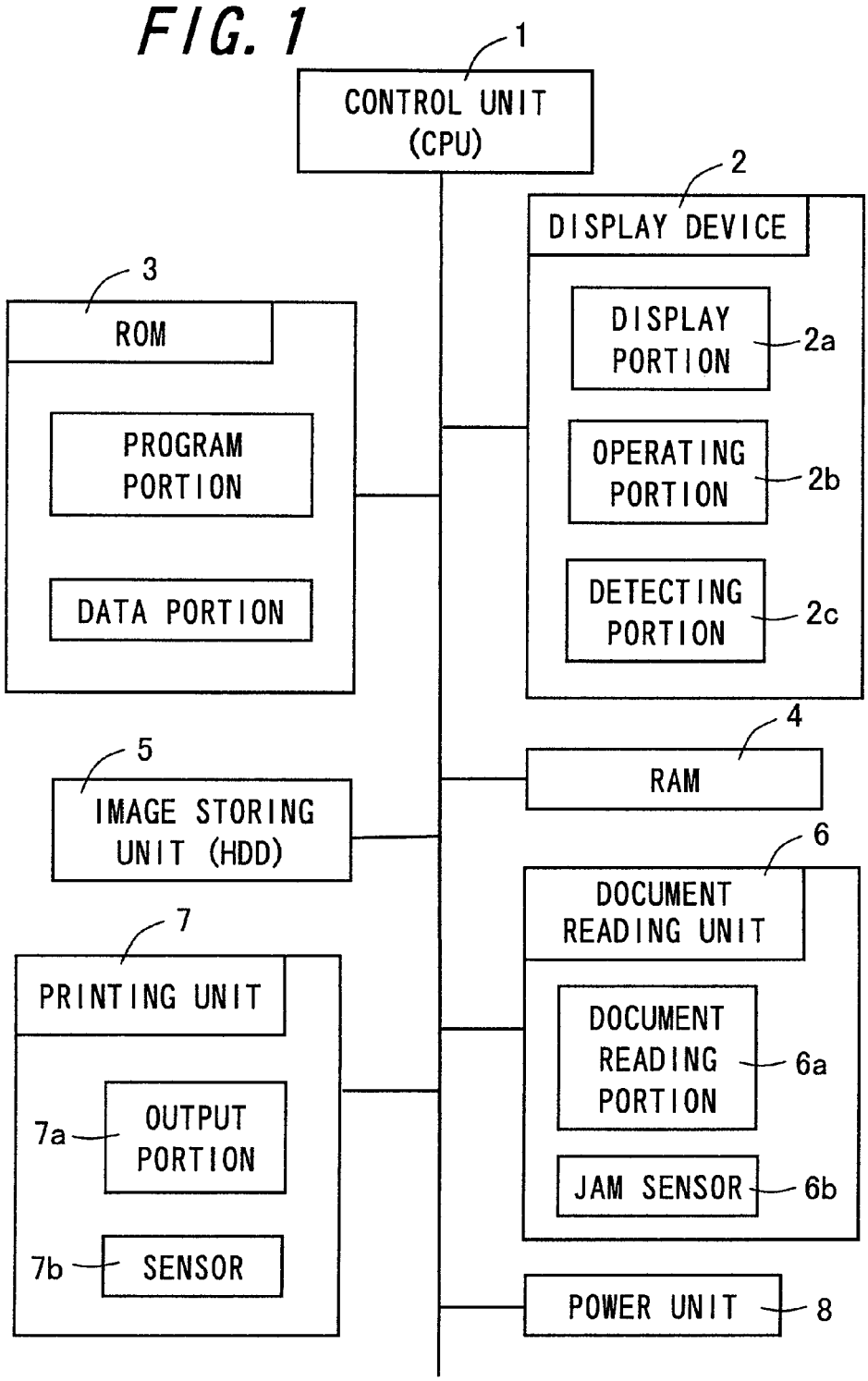
FIG. 1 is a block diagram showing an electric configuration of a copier according to one embodiment of the invention.

Now referring to the drawings, preferred embodiments of the invention are described below.

FIG. 1 is a block diagram showing an electric configuration of a copier 100 according to one embodiment of the invention. The copier 100 includes a control unit 1, a display device 2, a ROM 3, a RAM 4, an image storing unit 5, a document reading unit 6, a printing unit 7, and a power unit 8.

The control unit 1 is implemented by a CPU (an abbreviation of "Central Processing Unit") or the like device to control the whole copier. The display device 2 has a display portion 2*a* which is composed of a liquid crystal display or the like element, an operating portion 2*b* which is composed of various operation keys, switches, and the like element, and a detecting portion 2*c* for detecting an orientation of the display device 2 and an angle of an arm supporting the display device 2.

The ROM (an abbreviation of "Read Only Memory") 3 serves as a storing unit storing various processing programs and various data. The ROM 3 stores, for example, data of three-dimensional apparatus view showing the configuration, external appearance, and internal configuration, of the copier, and procedure data indicating how to perform maintenance work. The RAM (an abbreviation of "Random Access Memory") 4 serves as a storing unit temporarily storing various settings for printing, document-reading, etc.

The image storing unit 5 serves as an image storing unit in which image data read by the document reading unit 6 accumulates. The document reading unit 6 has a scanner portion 6*a* for reading image data on documents, and a jam sensor 6*b* for detecting a jam. The printing unit 7 has an output portion 7*a* for outputting image data which are thus printed onto recording paper in the electrophotographic or inkjet process, and a jam sensor 7*b* for detecting a jam. The power unit 8 supplies power to the whole copier.

Figure 2:
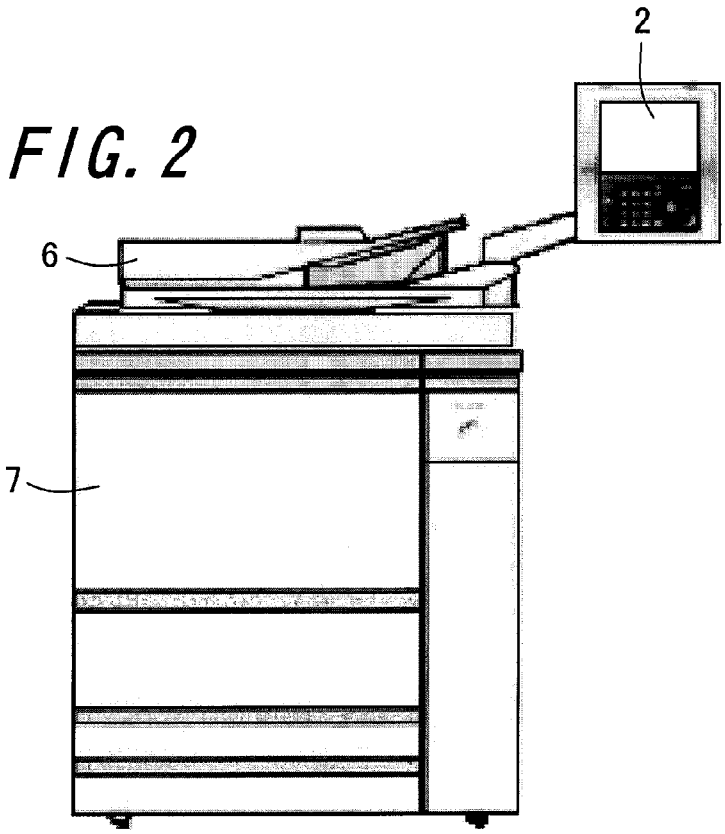
FIG. 2 is an external view showing an entire configuration of the copier.

FIG. 2 is an external view showing an entire configuration of the copier 100. On top of the printing unit 7, the document reading unit 6 is arranged which includes a document automatic feeder for automatically feeding documents to be read and in which the display device 2 is mounted. The display device 2 is supported by an arm on top of an apparatus main body so as to protrude therefrom, and by displacing the arm, it is possible to shift a position of the display device 2.

Figure 3:
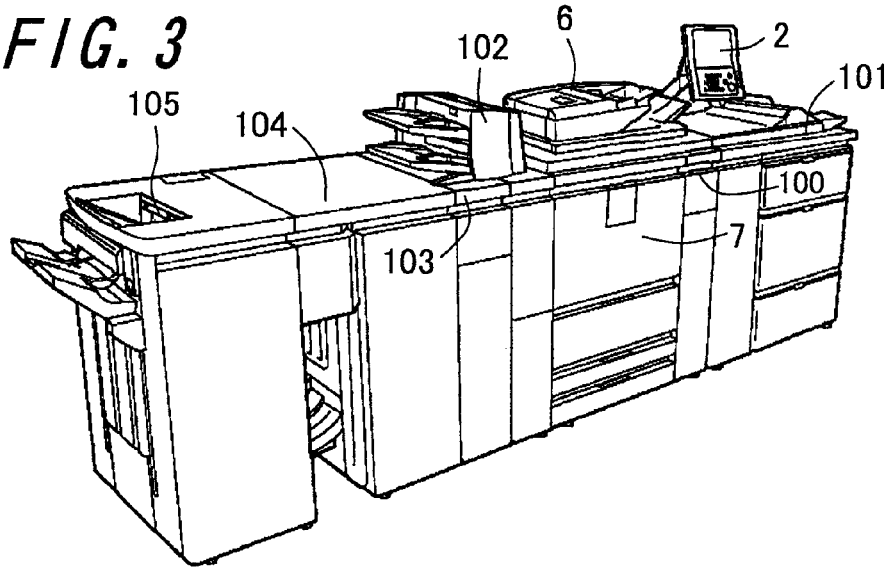
FIG. 3 is an external view showing a configuration of the copier provided with optional devices.

FIG. 3 is an external view showing a configuration of the copier 100 provided with optional devices. On the right-hand side of the copier 100 in the drawing, a large capacity paper-feeding cassette 101 is provided which can be loaded with a large quantity of recording paper, while on the left-hand side of the copier 100 in the drawing are provided an inserter 102 for inserting a cover sheet or a slip sheet into printed sheets of recording paper, a creaser unit 103 for folding outputted recording paper, a saddle-stitching unit 104 for folding recording paper in the middle, and a finisher 105 for stapling or punching.

As mentioned above, the image forming apparatus may have many functions added by mounting optional devices thereon, but if the whole apparatus including the optional devices extremely increases in size, it will make it difficult to do maintenance work such as a jam clearing process.

The procedure itself of the maintenance work is complicated, and generally speaking, the display portion 2*a* of the display device 2 shows moving images to explain the work procedure, thereby improving workers' work efficiency.

Figure 4:
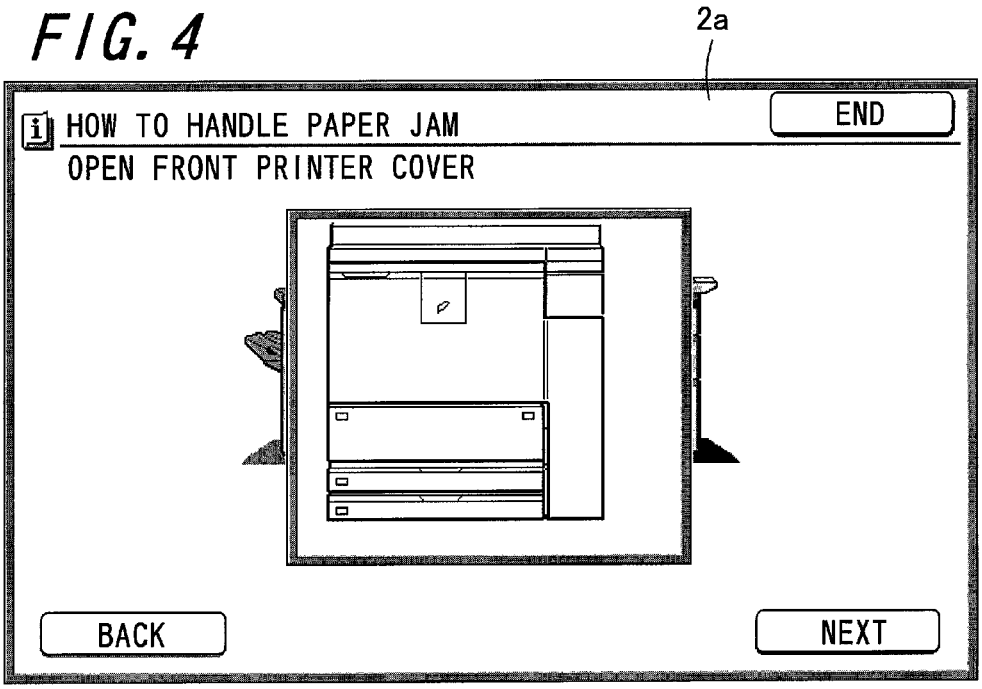
FIG. 4 is a view showing a display example of jam guidance as a work procedure for clearing a paper jam in the copier.
Figure 5:
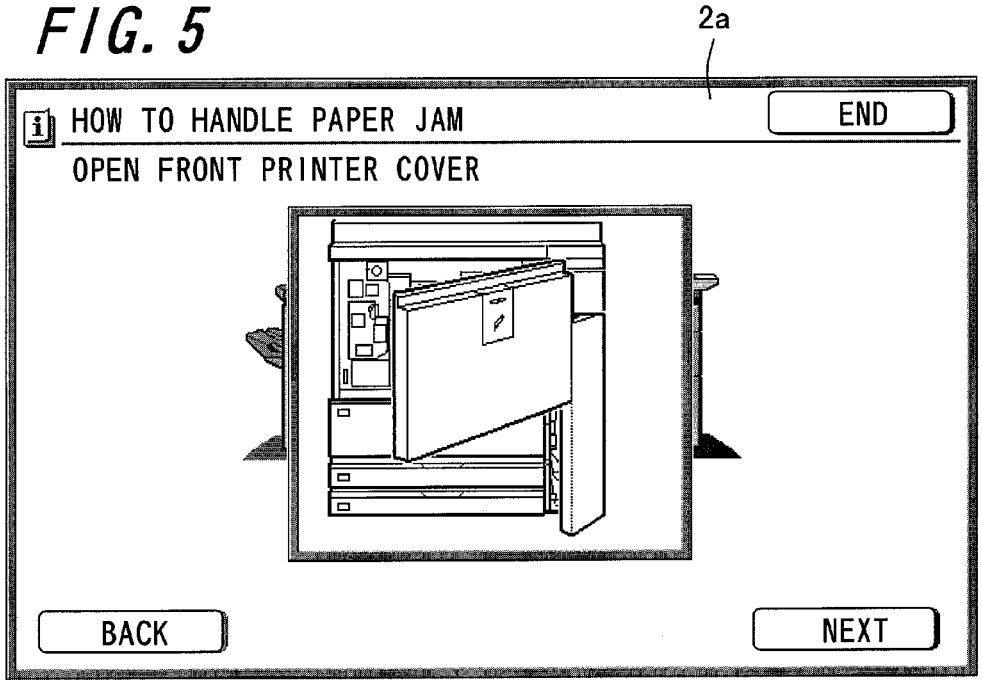
FIG. 5 is a view showing a display example of jam guidance as a work procedure for clearing a paper jam in the copier.
Figure 6:
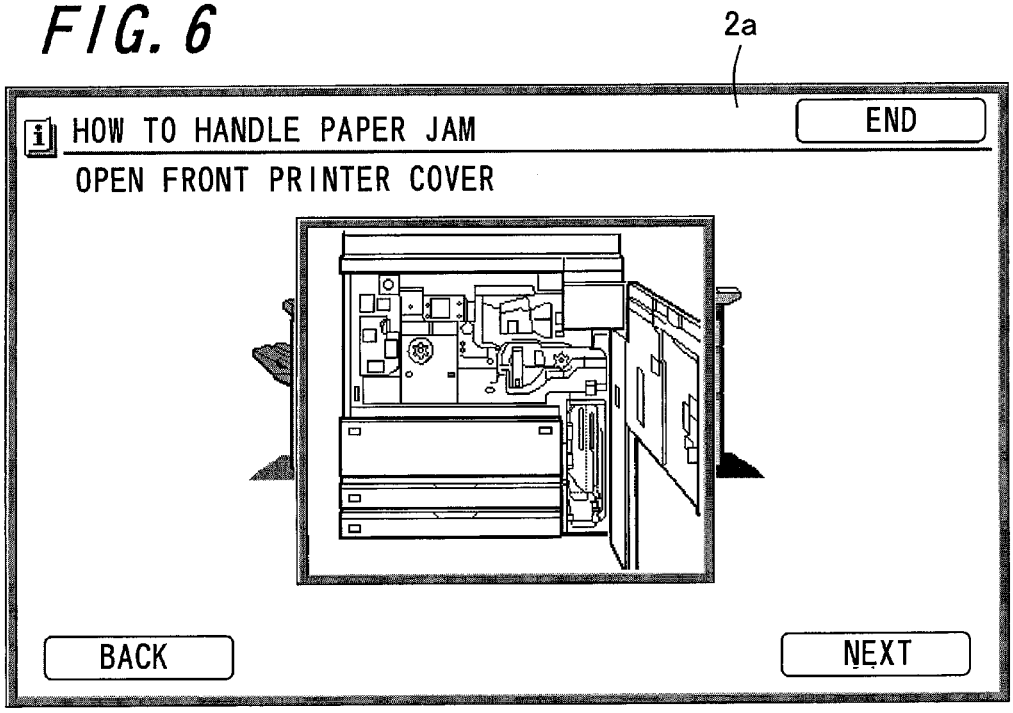
FIG. 6 is a view showing a display example of jam guidance as a work procedure for clearing a paper jam in the copier.

FIGS. 4 to 6 are views each showing a display example of jam guidance as the work procedure for clearing a paper jam in the copier 100. This jam guidance shows a part of the work procedure for a jam taking place inside the printing unit 7 and is displayed in form of moving image data based on Flash or the like system on the display portion 2*a* of the display device 2.

In the present display example, the phrase "OPEN FRONT PRINTER COVER" is displayed to specifically indicate what to do, with the external view of the apparatus to indicate where the front cover to be opened is located or in which direction the front cover is to be opened.

By pressing soft keys such as "NEXT" or "BACK" appearing on the display screen, the display screen can be properly switched back and forth among these images shown in FIGS. 4 to 6. When a worker performs an operation; for example, opens a cover, according to the description on the display screen, then the display screen is switched without pressing the keys.

Figure 7:
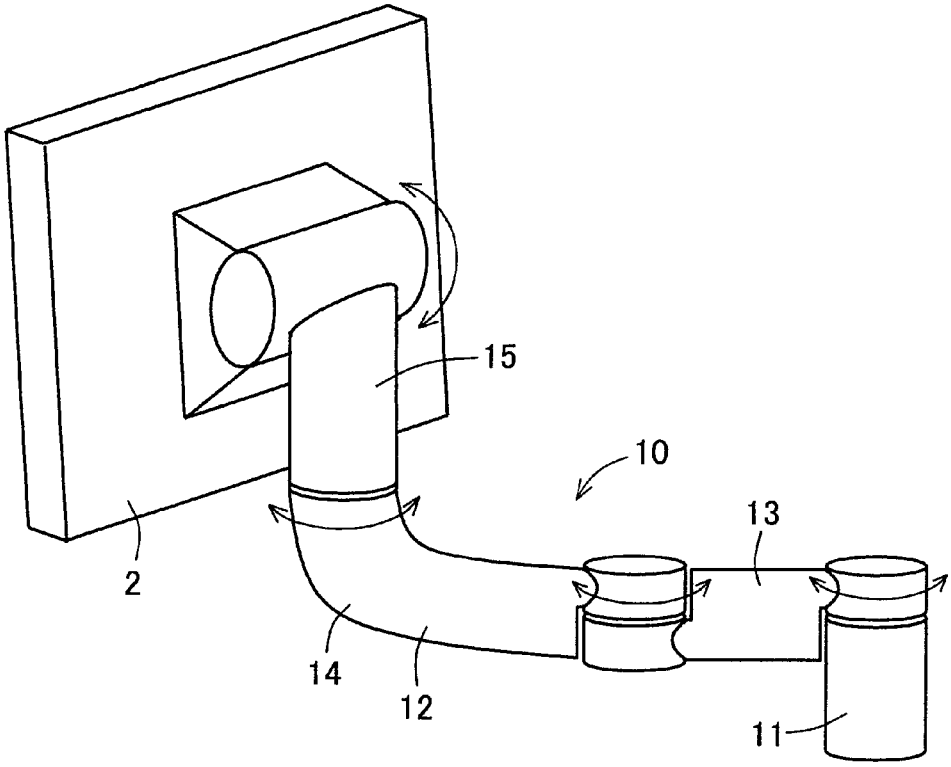
FIG. 7 is an external view showing a configuration of a support device supporting a display device mounted on an apparatus main body.

FIG. 7 is an external view showing a configuration of a support device 10 supporting the display device 2 mounted on the apparatus main body. The support device 10 is composed of a strut 11 provided on the apparatus main body, and an arm 12 which has one end portion connected to the strut 11 and the other end portion connected to the display device 2 and which changes a position of the display device 2 in reference to the strut 11.

The arm 12 is composed of three arm members: a first arm 13, a second arm 14, and a third arm 15. The first arm 13 is a columnar member which has one end portion connected to the strut 11 and extends in a horizontal direction. The one end portion of the first arm 13 is configured to be angularly displaced around a vertical axis of the strut 11. The first arm 13 is thus angularly displaced in a horizontal plane around the strut 11.

The second arm 14 has a horizontal part extending in a horizontal direction, and a vertical part which is connected with the horizontal part and bends about 90 degrees upwardly in a vertical direction. The second arm 14 has one end portion in the horizontal part connected to the other end portion of the first arm 13. The one end portion of the second arm 14 is configured to be angularly displaced around the vertical axis relative to the first arm 13. The second arm 14 is thus angularly displaced in the horizontal plane around the strut 11 via the first arm 13 and is also angularly displaced in the horizontal plane relative to the other end portion of the first arm 13.

The third arm 15 has a part extending upward in the vertical direction, and a connection part which includes a horizontally-extending axis of rotation and is connected to the back of the display device 2. One end portion of the third arm 15 in the part extending upward in the vertical direction is connected to the other end portion of the second arm 14 in its vertical part. The third arm 15 itself is thus configured to be angularly displaced around a vertical axis, and the display device 2 is configured so that the display screen of the display portion 2*a* is tilted by the angular displacement of the third arm 15 around its horizontally-extending axis of rotation.

As described above, the support device 10 is configured such that the strut 11 and the arm 12 can be angularly displaced relative to each other and that the arm 12 and the display device 2 can be angularly displaced relative to each other, and a detector for detecting an angle of rotation, such as a rotary encoder or a volume, is built into each connection part therebetween. As a worker grabs the display device 2 and moves the display screen of the display portion 2*a* to an easily-viewable position, angles measured by the detectors can be used to determine the position of the display device 2, the orientation of the display screen, or the like element.

The following description is directed to how the display device 2 is displaced.

Figure 8:
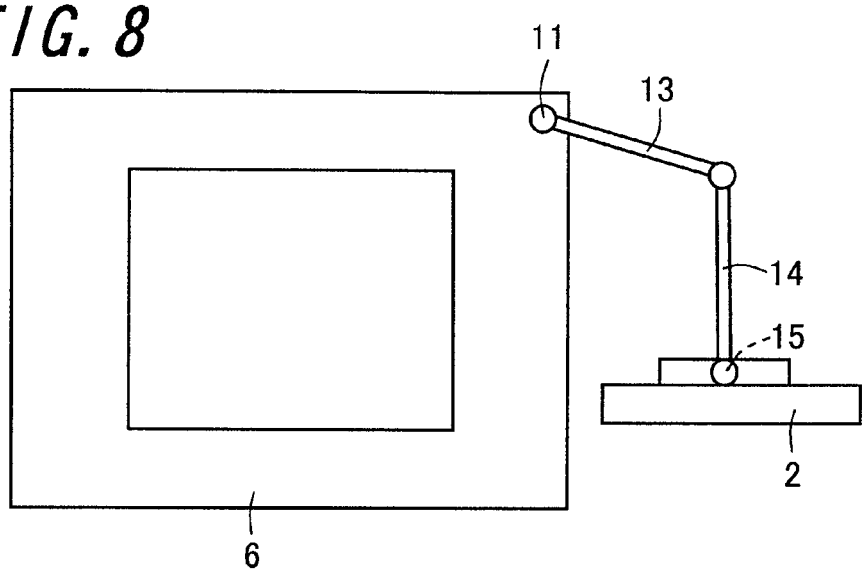
FIG. 8 is a top plan view of the copier.
Figure 9:
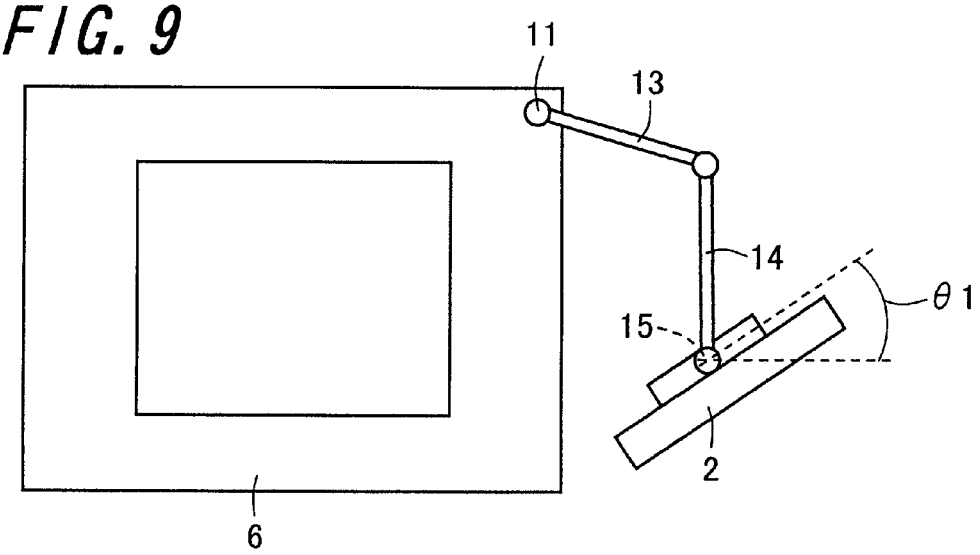
FIG. 9 is a top plan view of the copier.

FIGS. 8 and 9 are top plan views of the copier 100. FIG. 8 shows the copier 100 with the display device 2 which has not yet been displaced and has its display screen facing the front of the copier 100. FIG. 9 shows the copier 100 with the display device 2 which has been displaced and has its display screen directed diagonally to the front of the copier 100.

The display device 2 is supported by the support device 10 supported by the apparatus main body, while the apparatus main body and the respective arms, and the arms and the display device 2, can be angularly displaced, independently.

These drawings show one example where with the display device 2 having its display screen directed in parallel with the vertical direction, the third arm 15 is angularly displaced around the vertical axis at the connection part between the second arm 14 and the third arm 15.

As mentioned above, the detector for detecting an angle of rotation is built into the connection part between the second arm 14 and the third arm 15. This enables the control unit 1 to recognize that when a worker turns the display device 2 in the horizontal direction by the angle θ1, the third arm 15 has been angularly displaced by the angle θ1 relative to the second arm 14.

In addition, the detector detects also that the other connection parts remain unchanged, which enables the control unit 1 to recognize that the angular displacement of the third arm 15 angularly displaces the display screen of the display device 2 in the horizontal direction by the angle θ1.

Figure 10:
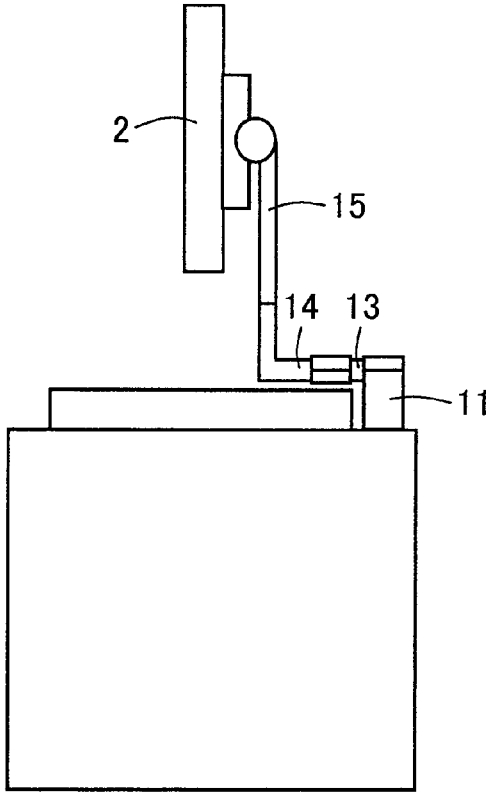
FIG. 10 is a side view of the copier.
Figure 11:
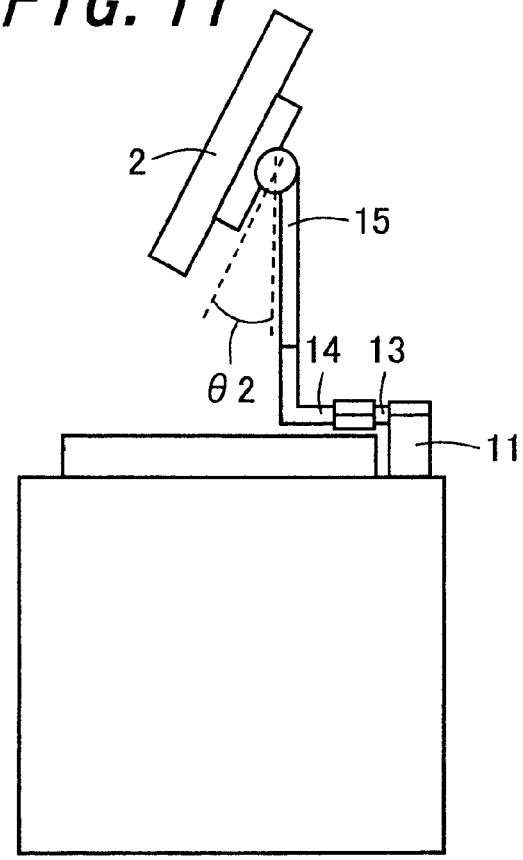
FIG. 11 is a side view of the copier.

Further, FIGS. 10 and 11 are side views of the copier 100. FIG. 10 shows the copier 100 with the display device 2 which has not yet been displaced. FIG. 11 shows the copier 100 with the display device 2 which has been displaced.

These drawings show one examples where with the display device 2 having its display screen directed in parallel with the vertical direction, the display device 2 is angularly displaced around the horizontal axis at the connection part between the third arm 15 and the display device 2.

As mentioned above, the detector for detecting an angle of rotation is built into the connection part between the third arm 15 and the display device 2. This enables the control unit 1 to recognize that when a worker turns the display device 2 in the horizontal direction by the angle θ2, the display device 2 has been angularly displaced by the angle θ2 relative to the third arm 15.

In addition, the detector detects also that the other connection parts remain unchanged, which enables the control unit 1 to recognize that the angular displacement of the display device 2 displaces the display screen of the display device 2 upward in the perpendicular direction by the angle θ2.

Figure 12:
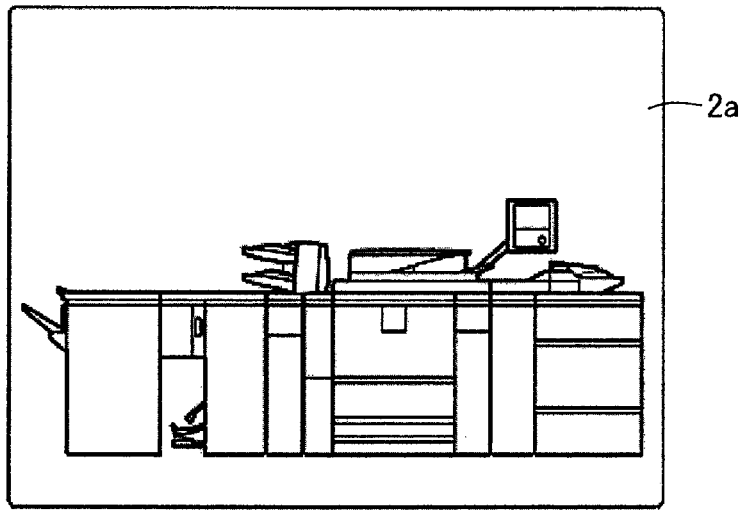
FIG. 12 is a view showing an image example appearing on a display portion of a display device.
Figure 13:
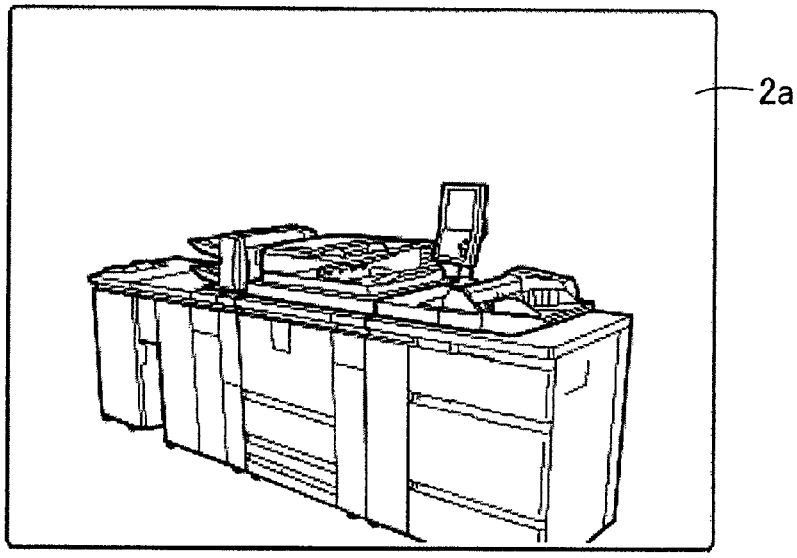
FIG. 13 is a view showing an image example appearing on the display portion of the display device.

FIGS. 12 and 13 are views each showing an image example appearing on the display portion 2*a* of the display device 2. FIG. 12 shows a display image example where the display screen of the display portion 2*a* faces the front of the copier 100 as shown in FIG. 8. FIG. 13 shows a display image example where the display screen of the display portion 2*a* is directed diagonally to the front of the copier 100 as shown in FIG. 9.

In the case where the display screen of the display portion 2*a* faces the front, a front view of the copier 100 is displayed as shown in FIG. 12.

Note that the control unit 1 can recognize in which direction the display screen faces, based on the detection result of the detecting portions of the support device 10, and therefore the control unit 1 only needs to control the display screen to show the external view of the copier 100 which is viewed in an opposite direction to the present orientation of the display screen; or viewed in a direction that the worker would look at the display screen.

When the display device 2 is grabbed by a worker, for example, and thereby becomes displaced so that the display screen of the display portion 2*a* is angularly displaced by the angle θ1 to be directed diagonally, the control unit 1 only needs to refer to the detected angle θ1 and thereby control the display screen to show the external view of the copier 100 which is viewed in the opposite direction to the orientation of the angularly displaced display screen. If the image data stored in the ROM 3 is three-dimensional image data, then the viewing direction only needs to be shifted in the horizontal direction by the angle θ1 which corresponds to the displacement amount θ1 so that image data shifted accordingly may be shown on the display portion 2*a*.

As described above, the copier 100 detects the orientation of the display screen of the display device 2, and if the display screen changes its orientation, the images appearing on the display screen may be changed accordingly.

It is determined how the copier 100 is viewed from the worker, and then screen display is performed so that an image appearing on the display device 2 looks the same as the copier 100 which the worker directly sees.

As a result, if a worker moves the display device 2 for maintenance work, for example, the image appearing on the display screen looks the same as the copier 100 which the worker directly sees. Even when the worker is working by checking from one to the other of the copier 100 and the display screen of the display device 2, it is possible to reduce discomfort of the worker and improve the work efficiency, because the apparatus which the worker directly sees is correlated with the image being displayed.

Figure 14:
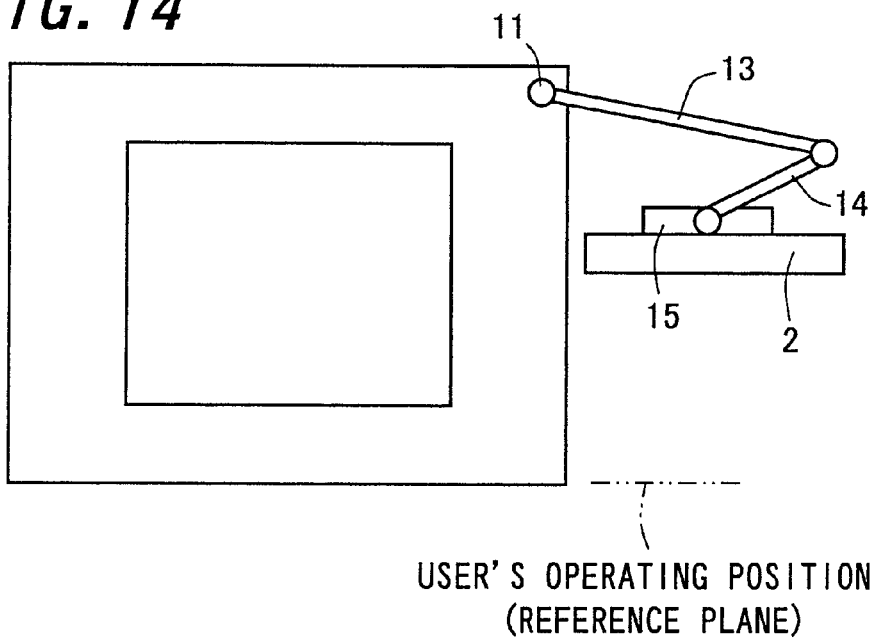
FIG. 14 is a top plan view of the copier.
Figure 15:
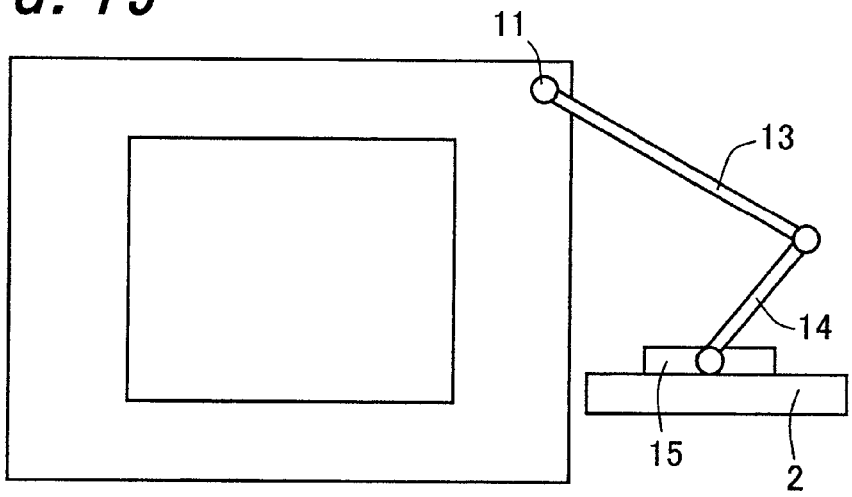
FIG. 15 is a top plan view of the copier.

FIGS. 14 and 15 are top plan views of the copier 100. FIG. 14 shows the copier 100 with the display device 2 which has not yet been displaced and has its display screen facing the front of the copier 100. FIG. 15 shows the copier 100 with the display device 2 which has been displaced forward in the direction of the front of the copier 100 with the display screen facing the front of the copier 100.

By respective angular displacement at the connection part between the strut 11 and the first arm 13, the connection part between the first arm 13 and the second arm 14, and the connection part between the second arm 14 and the third arm 15, the display device 2 is angularly displaced forward in the direction of the front of the copier 100 by moving only in the horizontal direction without changing in height with the display screen facing the front of the copier 100.

As mentioned above, the detector for detecting an angle of rotation is built into each of the connection part between the strut 11 and the first arm 13, the connection part between the first arm 13 and the second arm 14, and the connection part between the second arm 14 and the third arm 15. When a worker moves the display device 2 forward in the direction of the front of the copier 100 by a distance D, the above detector enables the control unit 1 to recognize the distance D by determining it based on the angles of rotation at the respective connection parts.

In addition, the detectors detect also that the other connection parts remain unchanged, which enables the control unit 1 to recognize that the display device 2 has been replaced merely by the distance D without changing the orientation of the display screen facing the front of the copier 100.

As a result, the position where the worker stands is defined as a front position of the copier 100, for example, and in reference to the front position, a distance between the worker and the display device 2 can be determined.

Next, another embodiment of the invention will be described.

In this embodiment, the second arm 14*a* of the support device 10 is configured to be stretchable, and a measuring instrument is provided which measures a displacement distance due to expansion and contraction of the second arm 14*a*. These are only differences between the present embodiment and the above embodiment, and in the present embodiment, the other components will be therefore denoted by the same reference numerals as those in the above embodiment and explanation of those components will be omitted.

The second arm 14*a* is connected to the first arm 13 and the third arm 15 as in the above embodiment, and for example, is composed of a plurality of hollow pipes which have different diameters from each other and incorporate a measurement instrument, such as a magnescale, for measuring a displacement distance.

Figure 16:
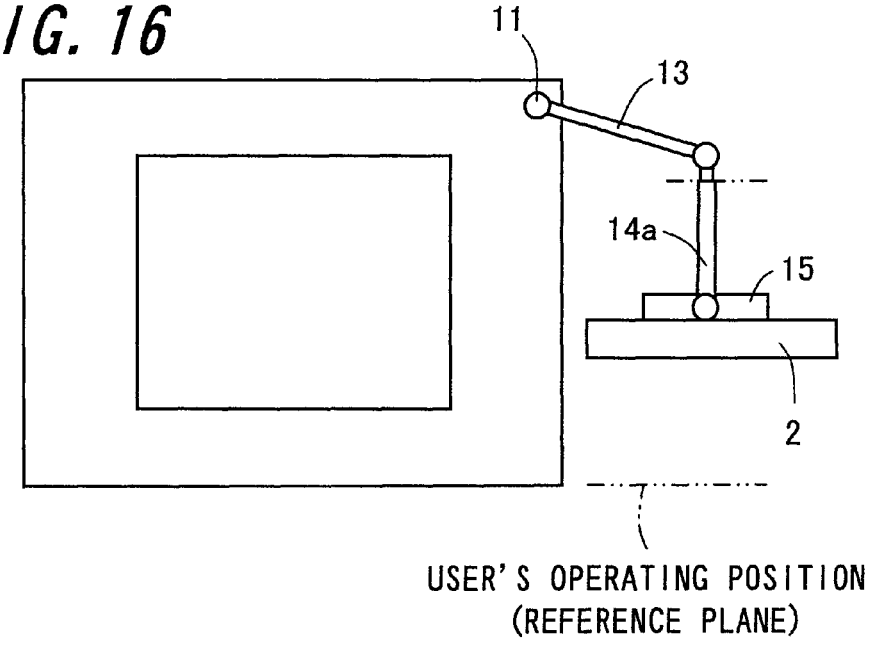
FIG. 16 is a top plan view of the copier.
Figure 17:
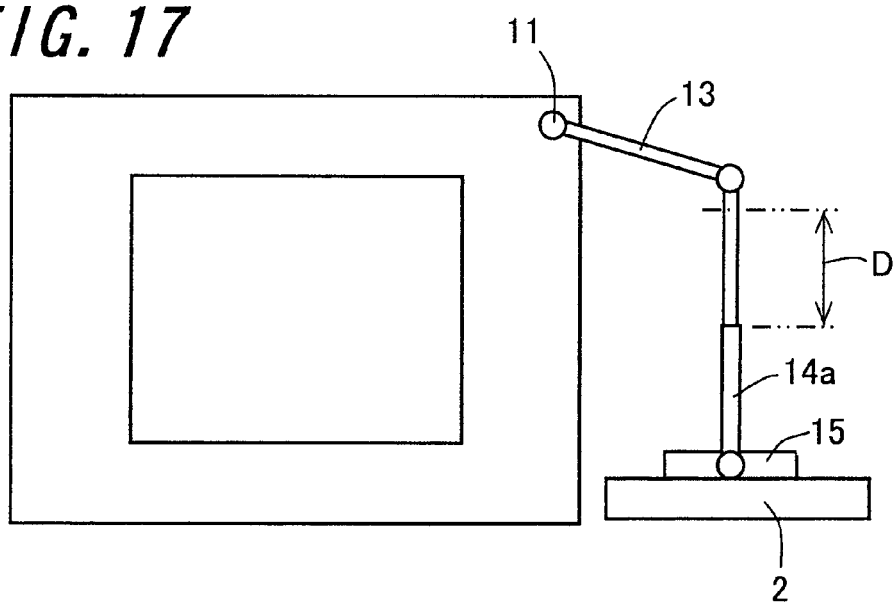
FIG. 17 is a top plan view of the copier.

FIGS. 16 and 17 are top plan views of the copier 100. FIG. 16 shows the copier 100 with the display device 2 which has not yet been displaced and has its display screen facing the front of the copier 100. FIG. 17 shows the copier 100 with the display device 2 which has been displaced forward in the direction of the front of the copier 100 with the arm stretched and the display screen facing the front of the copier 100.

With the second arm 14*a* being stretched, the display device 2 is displaced forward in the direction of the front of the copier 100 by moving only in the horizontal direction without changing in height with the display screen facing the front of the copier 100.

As mentioned above, the measurement instrument for measuring a displacement distance due to expansion and contraction of the second arm 14*a* is built into the second arm 14*a*. When a worker moves the display device 2 forward in the direction of the front of the copier 100 by a distance D, the above measurement instrument enables the control unit 1 to recognize the distance D by determining it based on the measured displacement distance. In addition, the measurement instrument detects also that the other connection parts remain unchanged, which enables the control unit 1 to recognize that the display device 2 has been displaced merely by the distance D without changing the orientation of the display screen facing the front of the copier 100.

As a result, the position where the worker stands is defined as a front position of the copier 100, for example, and in reference to the front position, a distance between the worker and the display device 2 can be determined.

Figure 18:
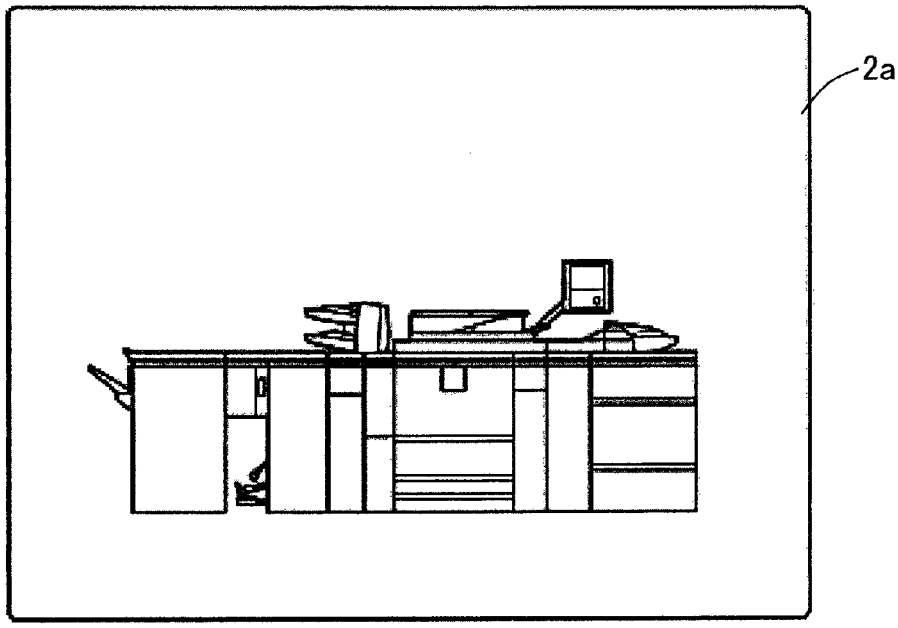
FIG. 18 is a view showing an image example appearing on the display portion of the display device.
Figure 19:
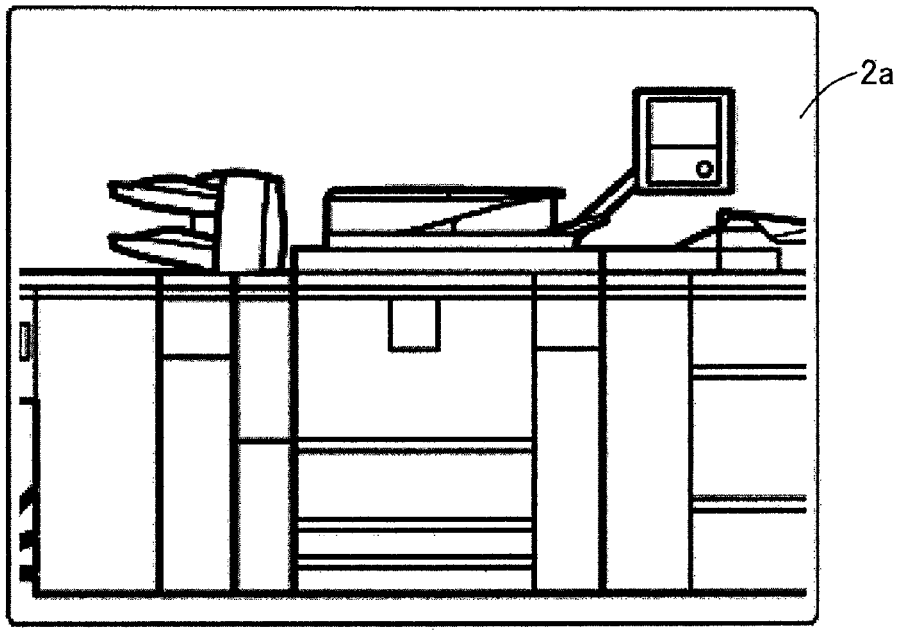
FIG. 19 is a view showing an image example appearing on the display portion of the display device.

FIGS. 18 and 19 are views each showing an image example appearing on the display portion 2*a* of the display device 2. FIG. 18 shows an example of image appearing on the display screen of the display portion 2*a* which faces the front of the copier 100 as shown in FIGS. 14 and 16. FIG. 19 shows an example of image appearing on the display screen of the display device 2 which has been displaced by the distance D forward in the direction of the front of the copier 100 as shown in FIGS. 15 and 17.

When the display device 2 is located at some distance away from the worker's working position as shown in FIGS. 14 and 16, the display device 2 zooms out and shows an image of the whole copier 100. When the display device 2 is located closer to the worker's working position as shown in FIGS. 15 and 17, the display device 2 zooms in and shows an image of a part of the copier 100.

The copier 100 thus detects the distance between the display device 2 and the worker, and if the distance changes, the copier 100 can change the images appearing on the display screen accordingly. It is determined how the copier 100 looks from the worker, and then screen display is performed so that an image appearing on the display device 2 looks the same as the copier 100 which the worker directly sees.

As a result, for example, when a worker moves the display device 2 during maintenance work, etc., then an image appearing on the display screen of the display device 2 looks the same as the copier 100 which the worker directly sees. Even when the worker is working by checking from one to the other of the copier 100 and the display screen of the display device 2, it is possible to reduce discomfort of the worker and improve the work efficiency, because the apparatus being seen directly is correlated with the image being displayed.

Note that although the image is zoomed in to be displayed on a larger scale as the worker and the display device 2 become closer to each other while the image is zoomed out to be displayed on a smaller scale as the worker and the display device 2 get away from each other in the above description, it may be possible to change settings of the apparatus by adopting the opposite configuration; that is, the image is zoomed out to be displayed on a smaller scale as the worker and the display device become closer to each other while the image is zoomed in to be displayed on a larger scale as the worker and the display device 2 get away from each other.

Figure 20:
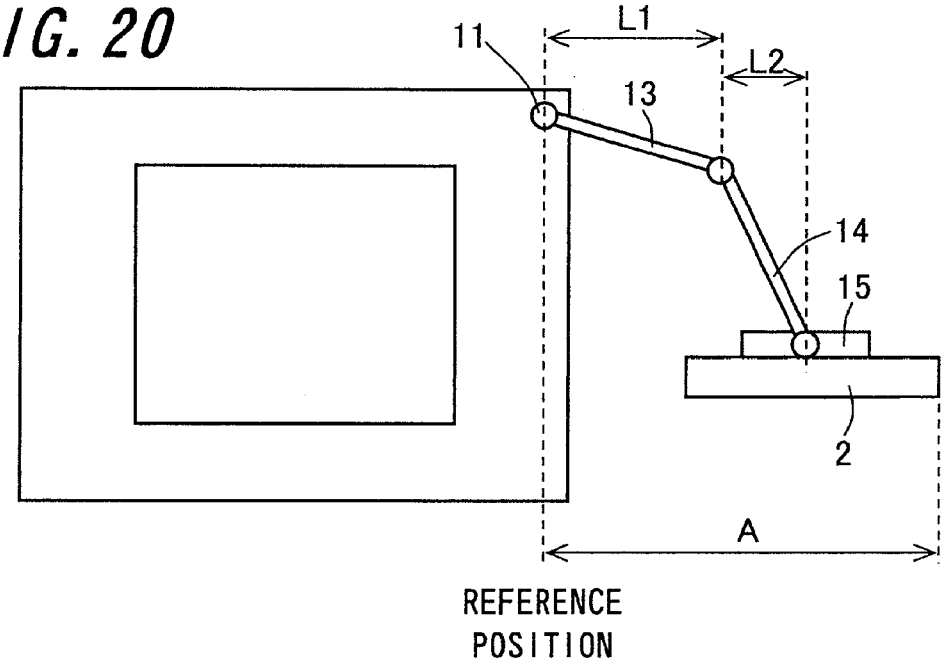
FIG. 20 is a top plan view of the copier 100.
Figure 21:
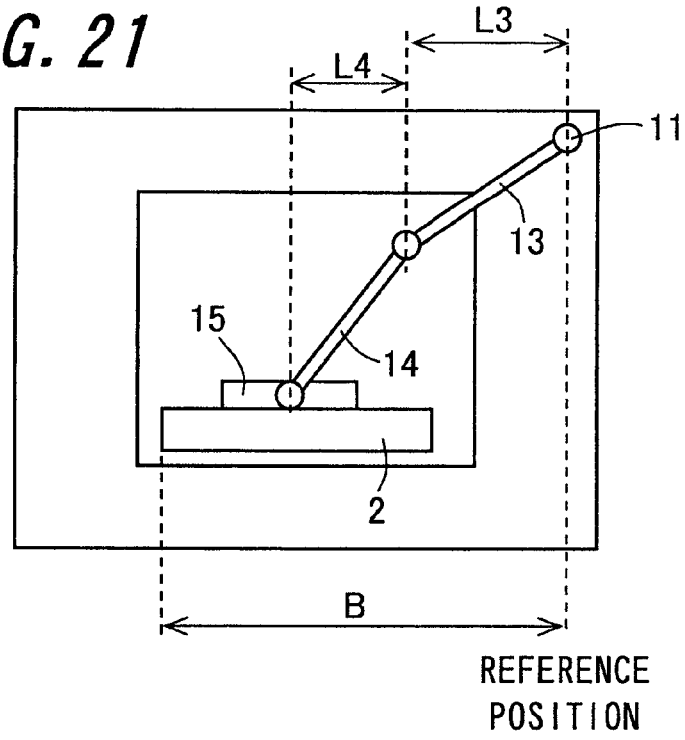
FIG. 21 is a top plan view of the copier 100.

FIGS. 20 and 21 are top plan views of the copier 100. FIG. 20 shows the copier 100 with the display device 2 which has not yet been displaced and has its display screen facing the front of the copier 100 and which is positioned away in one way (for example, to the right) in the horizontal direction by a distance A from a reference position that is now defined at where the strut 11 is located. FIG. 21 shows the copier 100 with the display device 2 which has been displaced and has its display screen facing the front of the copier 100 and which is positioned away in the other way (for example, to the left) in the horizontal direction by a distance B from the reference position that is now defined at where the strut 11 is located.

As shown in FIG. 3, the whole apparatus tends to extend laterally with the optional devices mounted thereon. It is therefore desirable to display the apparatus with those optional devices in the case where the support device supporting the display device 2 has moved in the horizontal direction.

By respective angular displacement at the connection part between the strut 11 and the first arm 13, the connection part between the first arm 13 and the second arm 14, and the connection part between the second arm 14 and the third arm 15, the display device 2 is displaced to the right by moving only in the one way of the horizontal direction without changing in height with the display screen facing the front of the copier 100. In this case, the horizontal distance L1 from the strut 11 to the connection part between the first arm 13 and the second arm 14, and the horizontal distance L2 from the connection part between the first arm 13 and the second arm 14 to the connection part between the second arm 14 and the third arm 15 can be determined based on the angles of rotation at the connection part between the strut 11 and the first arm 13, at the connection part between the first arm 13 and the second arm 14, and at the connection part between the second arm 14 and the third arm 15.

Referring to the horizontal distances L1 and L2, the control unit 1 thus can recognize that the display device 2 is positioned the distance A from the copier 100 on the right-hand side thereof.

Likewise, in the case where the display device 2 is displaced to the left by moving only in the other way of the horizontal direction, the horizontal distance L3 from the strut 11 to the connection part between the first arm 13 and the second arm 14, and the horizontal distance L4 from the connection part between the first arm 13 and the second arm 14 to the connection part between the second arm 14 and the third arm 15 can be determined based on the angles of rotation at the connection part between the strut 11 and the first arm 13, at the connection part between the first arm 13 and the second arm 14, and at the connection part between the second arm 14 and the third arm 15.

Referring to the horizontal distances L3 and L4, the control unit 1 thus can recognize that the display device 2 is positioned the distance B from the copier 100 on the left-hand side thereof.

Figure 22:
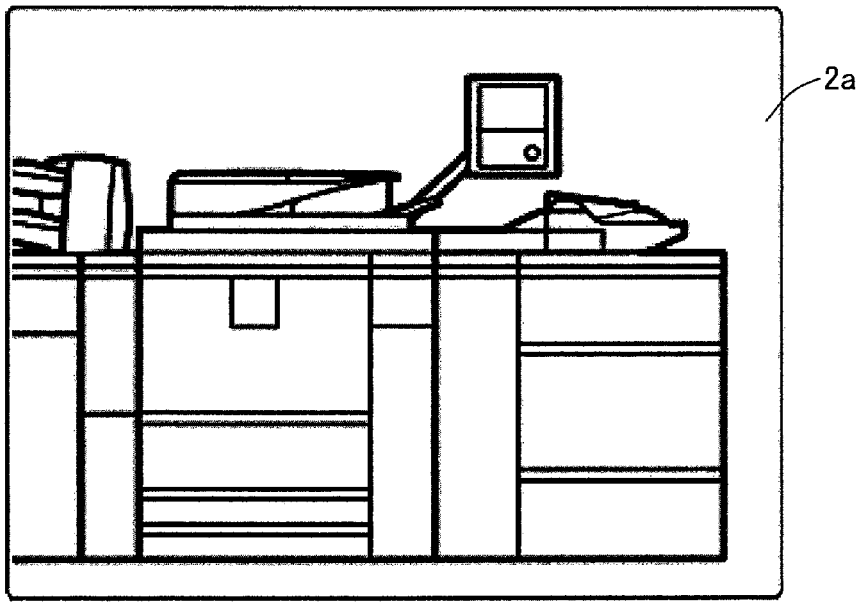
FIG. 22 is a view showing an image example appearing on the display portion of the display device.
Figure 23:
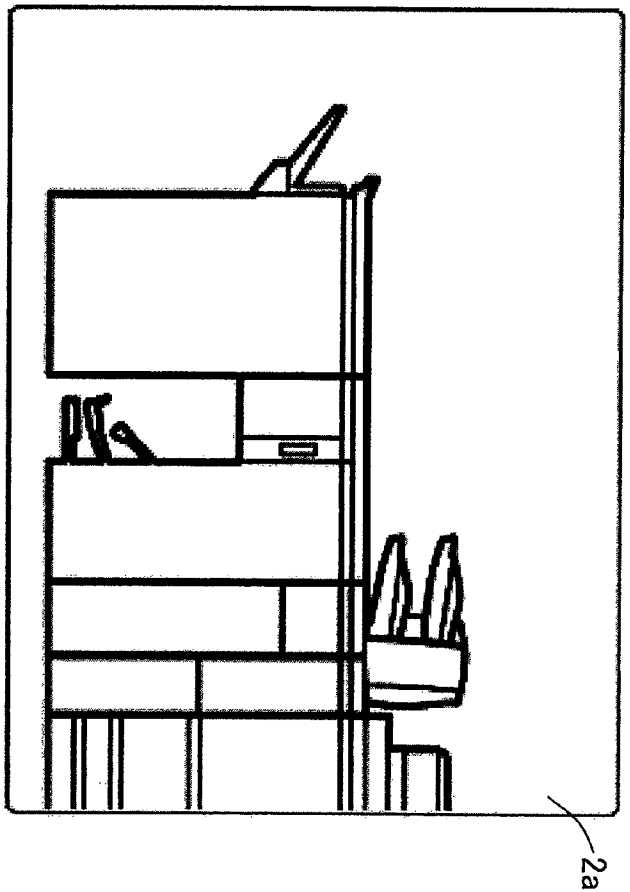
FIG. 23 is a view showing an image example appearing on the display portion of the display device.

FIGS. 22 and 23 are views each showing an image example appearing on the display portion 2*a* of the display device 2. FIG. 22 shows an example of image appearing on the display screen of the display portion 2*a* which faces the front of the copier 100 and is positioned the distance A from the reference of the strut 11 on the right-hand side thereof as shown in FIG. 20. FIG. 22 shows an example of image appearing on the display screen of the display device 2 which faces the front of the copier 100 and is positioned the distance B from the reference of the strut 11 on the left-hand side thereof as shown in FIG. 21.

When the display device 2 is positioned on the right-hand side in reference to the strut 11, a right-hand part of the whole copier 100 is displayed as shown in FIG. 22 according to the horizontal distances so that the optional devices also appear on the display screen. This makes it possible to display even the large capacity paper-feeding cassette disposed at the rightmost end of the copier.

When the display device 2 is positioned on the left-hand side in reference to the strut 11, a left-hand part of the whole copier 100 is displayed as shown in FIG. 23 according to the horizontal distances so that the optional devices also appear on the display screen. This makes it possible to display even the finisher disposed at the leftmost end of the copier.

As described above, the copier 100 detects the position of the display device 2 in the horizontal direction, and if the distance between the display device 2 and the strut changes, the images appearing on the display screen may be changed accordingly.

It is determined how the copier 100 is viewed from the worker, and then screen display is performed so that an image appearing on the display device 2 looks the same as the copier 100 the worker directly sees.

As a result, if a worker moves the display device 2 for maintenance work, for example, the image appearing on the display screen looks the same as the copier 100 which the worker directly sees. Even when the worker is working by checking from one to the other of the copier 100 and the display screen of the display device 2, it is possible to reduce discomfort of the worker improve the work efficiency, because the apparatus which the worker directly sees is correlated with the image being displayed.

As above, when orienting the display screen in the worker's working direction by angularly displacing the arms supporting the display device 2 as well as the display device 2 in the vertical and horizontal directions, the display screen shows a unit that the worker is going to perform maintenance work etc., and moreover can change its views according to the positional relation between the display device 2 and the worker, thus allowing to display the device in the same direction as that the worker directly sees. In addition, the display size or other elements can also change as desired, which contributes to enhancement in work efficiency of jam clearing or apparatus maintenance work.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus having a display device, the display device comprising:

a display portion for displaying apparatus status and setting;

a support portion for supporting the display portion in a manner that an orientation of a display screen of the display portion is displaceable;

a detecting portion for detecting amounts in which the display portion is displaced in two rotational directions which are independent of one another; and a control unit for changing display content appearing on the display portion according to a detection result of the detecting portion, wherein the display portion can display an external view of the image forming apparatus, and the control unit controls the display portion to change an angle of the external view of the image forming apparatus, which is viewed in an opposite direction to the orientation of the display screen, based on the detection result of the detecting portion.

2. The image forming apparatus of claim 1, wherein the support portion is configured so as to enable the display device to move longitudinally along a side surface of the image forming apparatus.

3. The image forming apparatus of claim 1, wherein the display portion displays a procedure of maintenance work.

4. The image forming apparatus of claim 3, wherein the procedure of maintenance work relates to clearing a jam.

* * * * *